US008608268B2

(12) United States Patent
Nitta et al.

(10) Patent No.: US 8,608,268 B2
(45) Date of Patent: Dec. 17, 2013

(54) RECORDING APPARATUS

(75) Inventors: Masaki Nitta, Yokohama (JP); Hiroaki Shirakawa, Kawasaki (JP); Yosuke Ishii, Kawasaki (JP); Yuhei Oikawa, Yokohama (JP); Satoshi Hayashi, Yokohama (JP); Taku Yokozawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 296 days.

(21) Appl. No.: 13/011,476

(22) Filed: Jan. 21, 2011

(65) Prior Publication Data

US 2011/0181645 A1 Jul. 28, 2011

(30) Foreign Application Priority Data

Jan. 27, 2010 (JP) ..... 2010-015850

(51) Int. Cl.
*B41J 29/38* (2006.01)

(52) U.S. Cl.
USPC ..... 347/14

(58) Field of Classification Search
CPC ..... B41J 2/2139
USPC ..... 347/9–11, 14, 19, 101, 104
See application file for complete search history.

(56) References Cited

U.S. PATENT DOCUMENTS

| | | | | |
|---|---|---|---|---|
| 6,843,548 | B2 * | 1/2005 | Arakawa et al. | 347/19 |
| 2003/0132981 | A1 | 7/2003 | Arakawa | |

FOREIGN PATENT DOCUMENTS

| | | | |
|---|---|---|---|
| JP | 2000-079684 | A | 3/2000 |
| JP | 2003-326705 | A | 11/2003 |
| JP | 2006-142806 | A | 6/2006 |
| JP | 2007-045107 | A | 2/2007 |
| JP | 2008-173920 | A | 7/2008 |

* cited by examiner

*Primary Examiner* — An Do
(74) *Attorney, Agent, or Firm* — Canon USA, Inc., IP Division

(57) ABSTRACT

A recording apparatus includes a first acquisition unit configured to acquire a speed of ink discharged from a recording head, a second acquisition unit configured to acquire information relating to a speed change based on the speed acquired by the first acquisition unit and a reference speed; a setting unit configured to set driving information relating to the recording head based on the information relating to the speed change acquired by the second acquisition unit, and a drive unit configured to drive the recording head based on the driving information set by the setting unit.

18 Claims, 7 Drawing Sheets

FIG.4A
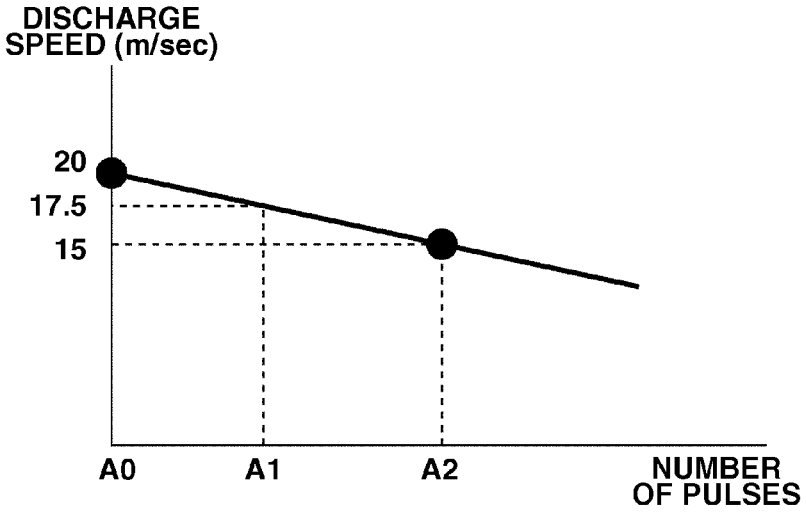
FIG.4B
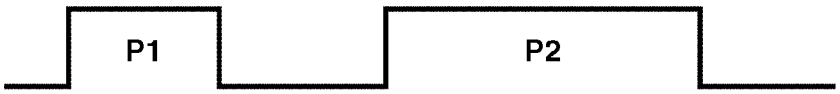
FIG.4C
| PULSE No. | P1 (μsec) | P2 (μsec) |
|---|---|---|
| No. 1 | 0.18 | 0.63 |
| No. 2 | 0.24 | 0.58 |
| No. 3 | 0.30 | 0.53 |
FIG.4D
| NUMBER OF PULSES | DISCHARGE SPEED | RATE OF VARIATION | PULSE No. |
|---|---|---|---|
| A0 | 20.0 m/sec | 0.0% | No. 1 |
| A1 | 17.5 m/sec | 12.5% | No. 2 |
| A2 | 15.0 m/sec | 25.0% | No. 3 |

RECORDING APPARATUS

BACKGROUND OF THE INVENTION

1. Field of the Invention

The present invention relates to a recording apparatus for discharging ink.

2. Description of the Related Art

In an inkjet recording apparatus, an amount and a discharge speed of ink to be discharged, for example, are to be stabilized to keep a quality of a printed image constant. As the recording apparatus is used, however, the amount and the discharge speed of the ink to be discharged gradually change by various factors. Japanese Patent Application Laid-Open No. 2003-326705 discusses a recording apparatus including a unit for measuring a discharge speed of ink. The recording apparatus measures the discharge speed of ink, and changes a driving condition based on a result of the measurement. More specifically, a difference between the discharge speed and a target speed is found, and calculation and reference to a table previously prepared are performed according to the speed difference, to determine the driving condition.

There may occur an individual difference in measured values between measurement units provided in recording apparatuses. If a recording head mounted on a recording apparatus is mounted on another recording apparatus, therefore, a discharge speed measured by the measurement unit differs depending on the recording apparatus. There is also an individual difference between recording heads. Even if each recording head is mounted on the same recording apparatus, a discharge speed may differ depending on individual recording heads. Japanese Patent Application Laid-Open No. 2003-326705 does not assume such a case. Therefore, an appropriate driving condition cannot be set.

SUMMARY OF THE INVENTION

According to an aspect of the present invention, a recording apparatus for performing recording using a recording head for discharging ink includes a first acquisition unit configured to acquire a speed of the ink discharged from the recording head, a second acquisition unit configured to acquire information relating to a speed change based on the speed acquired by the first acquisition unit and a reference speed, a setting unit configured to set driving information relating to the recording head based on the information relating to the speed change acquired by the second acquisition unit, and a drive unit configured to drive the recording head based on the driving information set by the setting unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 4A is a graph illustrating a change in a discharge speed, FIG. 4B illustrates a waveform of a drive pulse, FIG. 4C is a table listing pulse widths of drive pulses, and FIG. 4D is a table listing information relating to pulse widths corresponding to detected discharge speeds.

DESCRIPTION OF THE EMBODIMENTS

Various exemplary embodiments, features, and aspects of the invention will be described in detail below with reference to the drawings.

Figure 1:
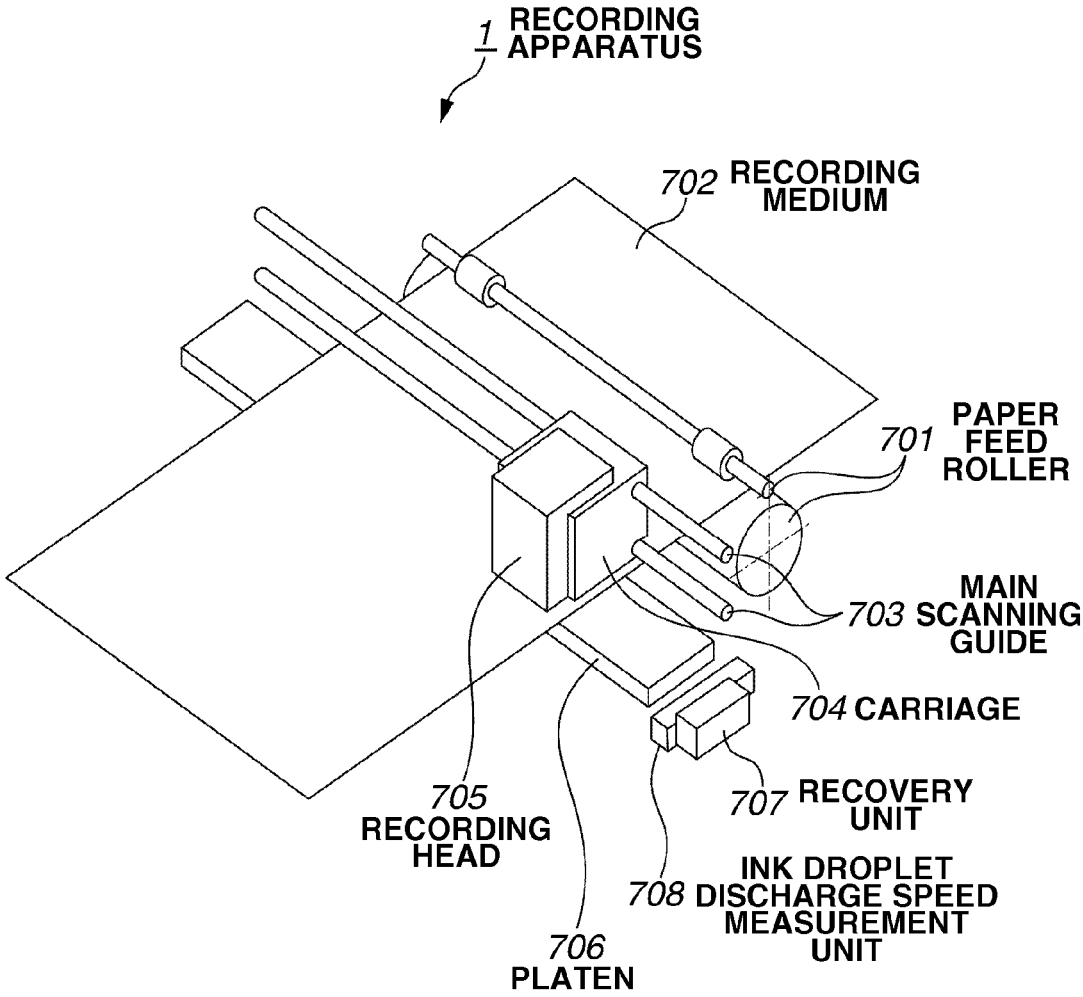
FIG. 1 is a perspective view of a recording apparatus according to a first exemplary embodiment of the present invention.

FIG. 1 is a perspective view of a recording apparatus (printer) 1 according to a first exemplary embodiment of the present invention. A paper feed roller 701 has a pair of rollers between which a recording medium (e.g., recording paper) 702 is sandwiched, and moves the recording medium 702 by rotating the rollers. A recording head 705 includes a discharge port on a surface opposite to a platen 706. The recording head 705 is held detachably in a carriage 704. A carriage drive unit (not illustrated) causes the carriage 704 to move along a main scanning guide 703. Thus, the recording head 705 performs scanning (hereinafter referred to as "main scanning") for the recording medium 702, and discharges ink. The recording head 705 is connected to an ink supply apparatus (not illustrated), and is supplied with ink. The platen 706 is provided below the recording head 705, the recording medium 702 is held on the platen 706 at the time of recording, and a gap between the recording medium 702 and the recording head 705 is maintained at a predetermined distance. A recovery unit 707 for keeping a state of the discharge port in the recording head 705 appropriate and a measurement unit 708 for measuring a discharge speed of ink are provided beside the platen 706. The recording apparatus 1 further includes a recording medium feed unit for feeding the recording medium 702 to the paper feed roller 701 and a recording medium discharge unit for taking out the recording medium 702 on which recording has ended, which are not illustrated.

When a signal representing an instruction to start recording is input to the recording apparatus 1, a recording medium feed unit (not illustrated) causes a leading edge of the recording medium 702 to be fed to a position of the paper feed roller 701 from the upper right of the figure. The paper feed roller 701 then feeds the recording medium 702 so that the recording head 705 is located at a printing start position on the recording medium 702 in response to a recording signal. The recording head 705 then discharges ink onto the recording medium 702 while performing main scanning so that an image is printed. Then, the paper feed roller 701 conveys the recording medium 702 by a predetermined amount (this operation is hereinafter referred to as "sub scanning"). The recording head 705 performs main scanning again, to discharge ink onto the recording medium 702. The sub scanning and the main scanning are repeated so that recording is performed on the recording medium 702, and the recording medium 702 is discharged to the lower left of the figure.

Figure 2:
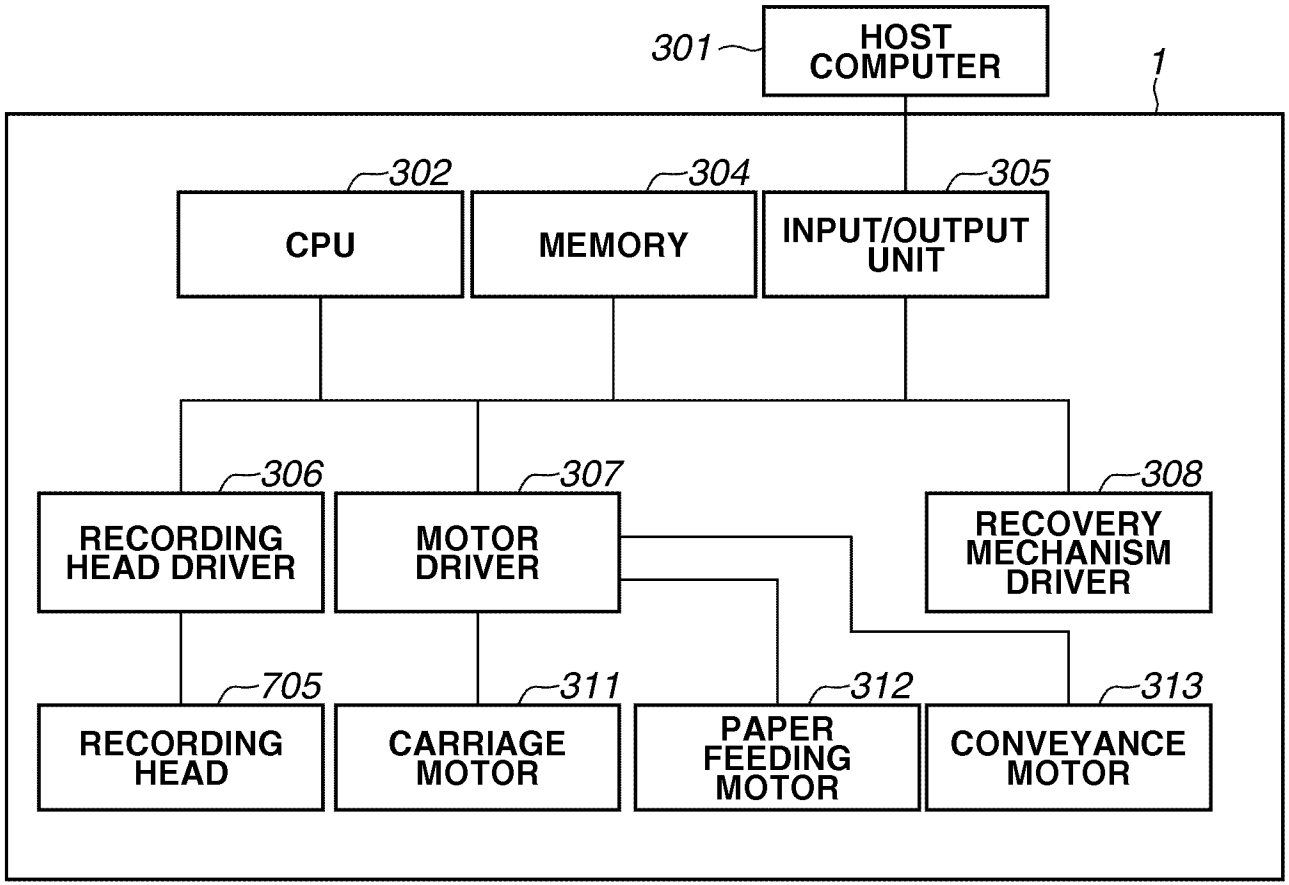
FIG. 2 is a control block diagram of the recording apparatus according to the first exemplary embodiment of the present invention.

FIG. 2 is a block diagram illustrating a control configuration of the recording apparatus (printer) 1. A microprocessor (a central processing unit (CPU) 302) controls the recording apparatus 1. A memory 304 includes a read-only memory (ROM), a random access memory (RAM), and a nonvolatile memory (an electrically erasable programmable read-only memory (EEPROM)). The ROM stores a control program and various types of data to be executed. The RAM temporarily stores various types of data such as a work area for the CPU 302, image data, and head driving information. The RAM includes print buffers for respectively storing binary recording data corresponding to respective colors C (cyan), M (magenta), Y (yellow), and K (black) of ink. Each of the print buffers for the respective colors stores binary data representing discharge and binary data representing non-discharge. The binary data for each of the colors stored in the print buffers is read out by the CPU 302, and is sent to the recording head 705. The recording head 705 discharges ink based on the binary data, and performs recording on the recording medium 702.

An input/output unit 305 inputs multivalued data from a host computer 301, and outputs information relating to the recording apparatus 1 to the host computer 301. The CPU 302 converts the multivalued data input to the input/output unit 305 into the binary data described above.

A recording head driver (drive circuit) 306 drives the recording head 705 under control of the CPU 302. The CPU 302 acquires information relating to a change in a discharge speed (a rate of variation, a rate of change, or a speed ratio) in processing described below. The CPU 302 sets driving information in the recording head driver 306 based on the information relating to the change in the discharge speed. Thus, the recording head 705 performs driving corresponding to the driving information. A motor driver 307 drives a carriage motor 311, a paper feeding motor 312, a conveyance motor 313, and so on. The driving of each of the motors is controlled according to a drive instruction from the CPU 302. In addition thereto, a recovery mechanism driver 308 is provided for driving a recovery mechanism such as a suction pump.

The CPU 302 starts a control program stored in the memory 304 according to various types of information (e.g., a character pitch and a character type) input from the host computer 301 via the input/output unit 305, to drive each of the drivers.

Figure 3A:
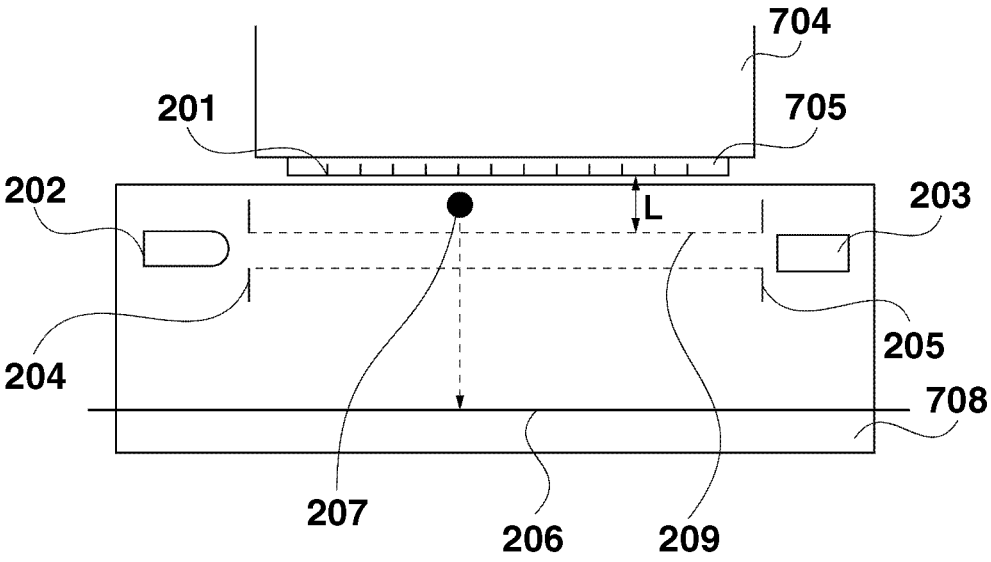
FIG. 3A is a side view illustrating a configuration of a discharge speed measurement unit.

FIG. 3A is a side view illustrating the measurement unit 708. The measurement unit 708 includes a light emitting element 202, alight receiving element 203, an aperture 204 for the light emitting element 202, an aperture 205 for the light receiving element 203, an ink absorber 206, and so on. The light emitting element 202 and the light receiving element 203 are located opposite each other across an ink droplet discharge area in the recording head 705. In order to narrow down alight flux 209 incident on the light receiving element 203 from the light emitting element 202 to improve a signal-to-noise (S/N) ratio, the aperture 204 is provided near the light emitting element 202, and the aperture 205 is provided near the light receiving element 203. The size of an opening, through which light passes, of each of the apertures 204 and 205 is set to 2 mm by 2 mm, for example. A round-type infrared light emitting diode (LED) having a diameter of 5 mm and having narrow directivity is used as the light emitting element 202, to emit light by applying a voltage of 5 volts. The light receiving element 203 reads a light amount of the light flux 209 incident on the light receiving element 203 from the light emitting element 202. Only when a discharge speed of a nozzle is detected, a voltage is applied to the light emitting element 202. A photodiode exhibiting a spectral sensitivity characteristic in which sensitivity is the highest in an infrared area, for example, is used as the light receiving element 203. Another element such as a semiconductor laser may be used as the light emitting element 202, and another element such as a phototransistor may be used as the light receiving element 203. The S/N ratio can be improved by increasing a light amount of the light emitting element 202 to increase a detection signal in a discharged state.

When the discharge speed is measured, discharge ports 201 in the recording head 705 are sequentially driven (a drive voltage is applied to a heater) so that an ink droplet 207 is discharged from the discharge port 201. The discharged ink droplet 207 is recovered after passing (blocking) the light flux 209 and landing on the ink absorber 206 of a sponge-like material. In a configuration illustrated in FIG. 3A, a distance between the recording head 705 and the light flux 209 is L.

Figure 3B:
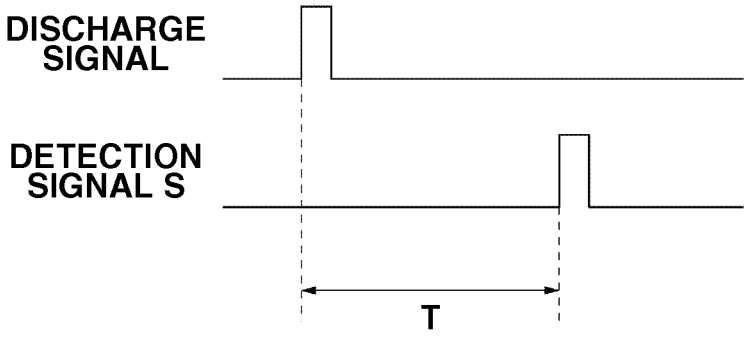
FIG. 3B illustrates a detection signal output from an optical sensor in the discharge speed measurement unit.

FIG. 3B illustrates a discharge signal representing timing at which the ink droplet 207 is discharged, and timing of a detection signal output from the light receiving element 203 when the ink droplet 207 passes through the light flux 209. In the first exemplary embodiment, a rising edge of a signal is detection timing, and a time difference between a rising edge of the discharge signal and a rising edge of the detection signal is T. Since the distance between the recording head 705 and the light flux 209 is L, a discharge speed (flying speed) V of the ink droplet 207 is calculated as V=L/T. The CPU 302 performs this calculation, for example.

Figure 5:
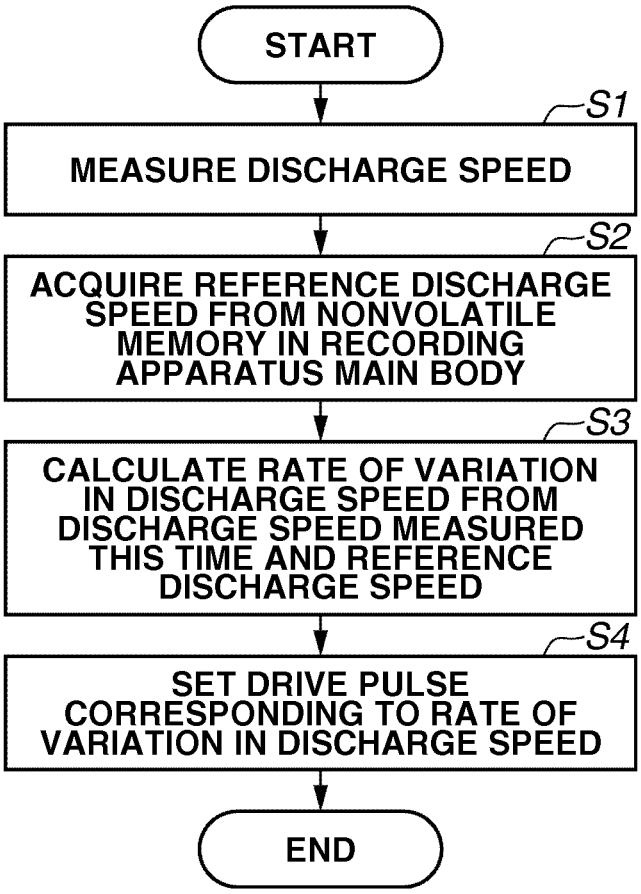
FIG. 5 is a flowchart according to the first exemplary embodiment.

Processing for acquiring a rate of variation in a discharge speed and processing for setting a driving condition according to the rate of variation in the discharge speed in the first exemplary embodiment will be described with reference to FIG. 5. In step S1, the CPU 302 measures a discharge speed. Processes illustrated in FIG. 5 are performed when the number of pulses driven from the previous measurement reaches a threshold value. More specifically, the flow illustrated in FIG. 5 is executed when the recording apparatus 1 performs a predetermined amount of recording. A value of ink the discharge speed of which greatly varies is determined to be lower than a threshold value of another ink. In step S2, the CPU 302 then acquires a reference discharge speed stored in a nonvolatile memory (304 in FIG. 2) in a recording apparatus main body. In step S3, the CPU 302 then calculates a rate of variation in a discharge speed from the discharge speed measured this time and the reference discharge speed. In step S4, the CPU 302 sets a drive pulse corresponding to the rate of variation in the discharge speed calculated in step S3. Thus, a value of the drive pulse is changed.

Calculation of a rate of variation in a discharge speed (flying speed) of ink in the first exemplary embodiment will be described. FIG. 4A is a graph illustrating how the discharge speed shifts. The horizontal axis represents the number of pulses and the cumulative number of times of discharge by the recording head 705. A reference discharge speed is 20 m/sec. When the recording head 705 is used, the discharge speed thus linearly decreases. The discharge speed, which is 20 m/sec when the number of pulses is A0, decreases to 15 m/sec when the number of pulses is A2. In the first exemplary embodiment, the number of pulses in the first measurement is A0 in the recording apparatus 1. For example, in the measurement made when the number of pulses is A0, the recording head 705 is driven to discharge ink a predetermined number of times, predetermined calculation is performed for a plurality of speeds measured in the discharge, and a result of the calculation is a reference discharge speed. An average of the speeds can also be the reference discharge speed.

FIG. 4D illustrates a relationship between the number of pulses and a discharge speed and a relationship between the number of pulses and a rate of variation. The rate of variation is information relating to a change in the discharge speed. In the present exemplary embodiment, a table including three speeds will be described for simple illustration.

The discharge speed corresponding to the number of pulses A0 is stored as a reference discharge speed in the nonvolatile memory in the recording apparatus 1. If the discharge speed is 17.5 m/sec, for example, the rate of variation is 12.5% when calculated based on the reference discharge speed. If the discharge speed is 15 m/sec, the rate of variation is 25%.

For example, the CPU 302 refers to the table to set a driving condition No. 2 if the rate of variation is 12.5%. The CPU 302 refers to the table to set a driving condition No. 3 if the rate of variation is 25%.

FIG. 4B illustrates a drive pulse applied to the heater. In FIG. 4B, the horizontal axis represents time, and the vertical axis represents a voltage. A pulse P1 (prepulse) for preheating ink to a predetermined temperature and a pulse P2 (main pulse) for momentarily heating and film-boiling ink to discharge the ink are applied to the heater. The viscosity of the ink in the vicinity of the heater is decreased due to the preheating by the prepulse P1, and, therefore, growth of a bubble formed due to the film-boiling by the main pulse P2 is promoted so that the ink can be more smoothly discharged. The drive pulse usually includes the two pulses P1 and P2. The larger the pulse width of the prepulse P1 is, the lower the viscosity of the ink immediately before application of the main pulse P2 becomes. Therefore, the growth of the bubble is further promoted so that the discharge speed increases. On the other hand, the smaller the prepulse P1 is, the higher the viscosity of the ink becomes. Therefore, the growth of the bubble is not promoted so that the discharge speed decreases. When the width of the prepulse P1 is changed, the width of the main pulse P2 is adjusted so that total energy input to the heater becomes constant.

FIG. 4C illustrates a table of drive pulses. A driving condition in which a pulse width is large is selected when a discharge speed is low. The CPU 302 sets a pulse No. 2 when the discharge speed is 17.5 m/sec (the rate of variation is 12.5%), and sets a pulse No. 3 when the discharge speed is 15 m/sec (the rate of variation is 25%). This setting enables the discharge speed to be always set to 20 m/sec, which is the reference discharge speed.

As described above, the discharge speed can be kept constant by adjusting the pulse width of the drive pulse depending on the rate of variation in the discharge speed so that an image of high quality can be stably provided.

While control for setting the pulse width of the drive pulse has been described, control for changing a drive voltage and a pulse width may be performed.

A second exemplary embodiment will be described below. Description of similar contents to those of the first exemplary embodiment is not repeated. In measurement of a discharge speed, a distance between a recording head and an optical sensor becomes an important parameter. This distance is greatly affected by assembling positional accuracy of the recording head and the optical sensor. Even if the same recording head is mounted on individual inkjet recording apparatuses, the discharge speed differs in values due to an individual difference between respective measurement units provided in the inkjet recording apparatuses. Even if a discharge speed of ink in a recording apparatus is 20 m/sec, therefore, it is 19.5 m/sec when measured by another recording apparatus. A rate of variation in the discharge speed calculated by measuring the discharge speed is stored in a nonvolatile storage element in the recording head.

The second exemplary embodiment differs from the first exemplary embodiment in that in a control configuration, a recording head 705 is provided with a nonvolatile memory. A CPU 302 stores a rate of variation in a discharge speed in the nonvolatile memory provided in the recording head 705. If the recording head 705 is mounted on a recording apparatus 1, the rate of variation is read into a memory 304 in the recording apparatus 1.

Figure 6:
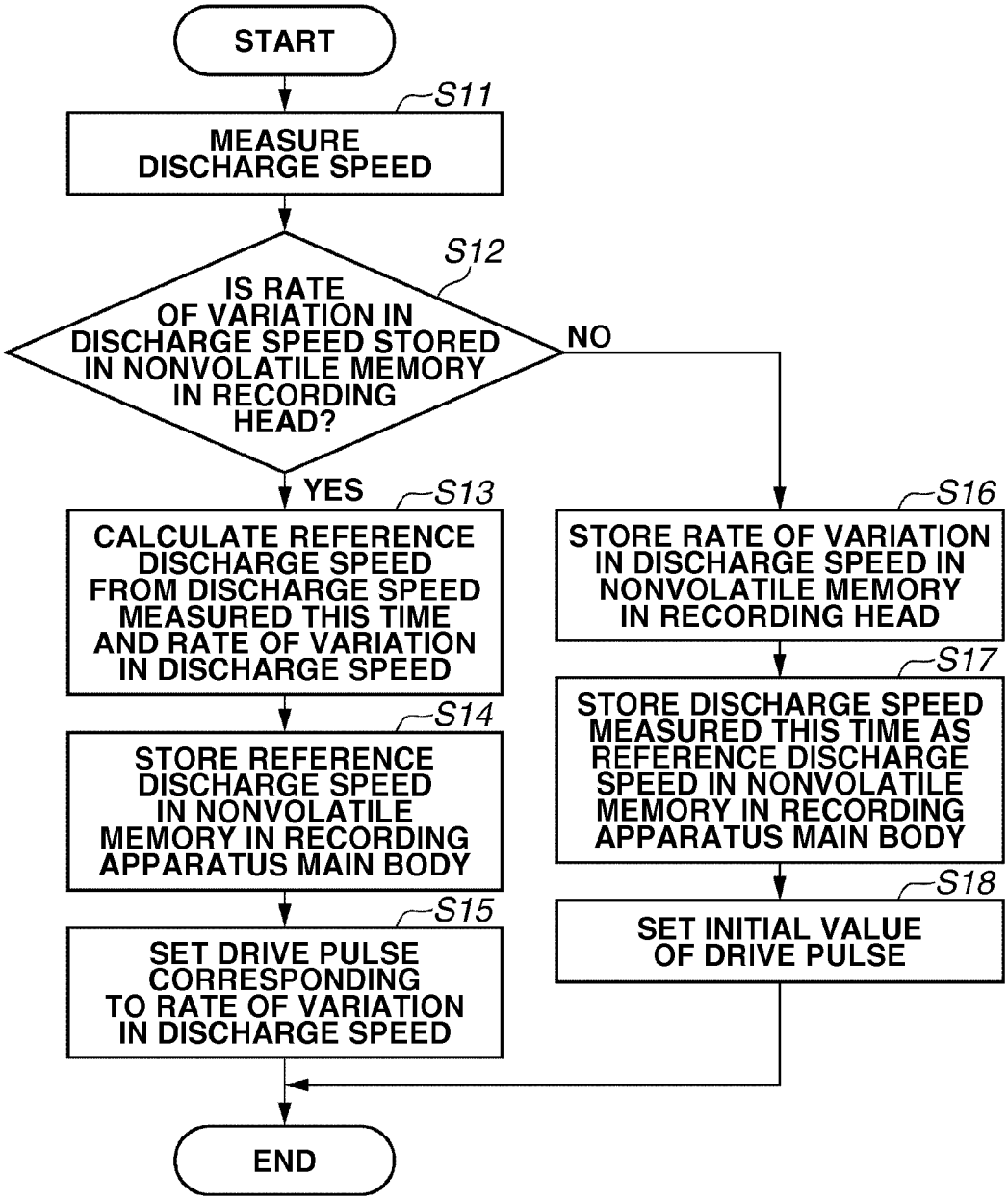
FIG. 6 is a flowchart according to a second exemplary embodiment of the present invention.

FIG. 6 is a control flow after mounting of the recording head 705 on the recording apparatus 1. This flow is executed after operations such as filling with ink are performed for the recording head 705. In step S11, the CPU 302 measures a discharge speed of the recording head 705 mounted on the recording apparatus 1. In step S12, the CPU 302 then determines whether a rate of variation in the discharge speed has already been stored in the nonvolatile memory in the recording head 705. The nonvolatile memory in the recording head 705 includes a flag indicating whether it stores the rate of variation. The CPU 302 refers to a value of the flag to perform processing. As another example, the CPU 302 may check the presence or absence of the rate of variation.

If the rate of variation has already been stored in the nonvolatile memory in the recording head 705 (the flag is set) (YES in step S12), the CPU 302 acquires the rate of variation from the nonvolatile memory in the recording head 705. In step S13, the CPU 302 calculates a reference discharge speed from the discharge speed measured in step S11 and the acquired rate of variation. In the second exemplary embodiment, the measured discharge speed is 12 m/sec, and the rate of variation in the discharge speed acquired from the nonvolatile memory in the recording head 705 is 25%. The reference discharge speed is 16 m/sec when calculated from the two values. More specifically, a discharge speed (reference discharge speed) at timing A0 in the recording apparatus 1 is not actually measured but can be acquired from a speed at the current time point and the rate of variation stored in the recording head 705.

In step S14, the CPU 302 then stores the calculated reference discharge speed in a nonvolatile memory in a recording apparatus main body. In step S15, the CPU 302 sets a drive pulse corresponding to the rate of variation in the discharge speed. Thus, a driving condition corresponding to the discharge speed is set. Therefore, ink can be discharged at the reference discharge speed in the recording head 705.

If the rate of variation has not been stored in the nonvolatile memory in the recording head 705 (the flag is not set) (NO in step S12), the recording head 705 is first mounted on the recording apparatus 1 (the discharge speed is first measured). In step S16, the CPU 302 stores 0%, which is the rate of variation in the discharge speed, in the nonvolatile memory in the recording head 705, and sets a flag. In step S17, the CPU 302 stores the discharge speed measured this time as a reference discharge speed in the nonvolatile memory provided in the recording apparatus main body. In this case, the CPU 302 performs driving at an initial value of the driving condition, considering that there is no decrease in the discharge speed. Accordingly, in step S18, the CPU 302 does not change a drive pulse corresponding to the reference discharge speed.

Figure 7:
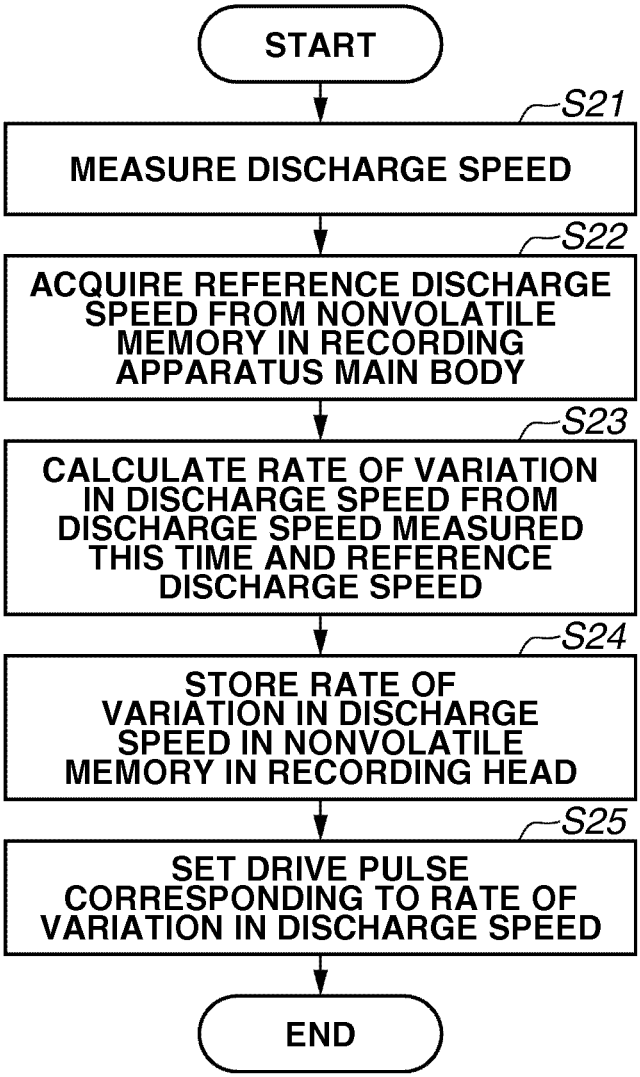
FIG. 7 is another flowchart according to the second exemplary embodiment.

FIG. 7 illustrates a control flow of second and subsequent measurements of a discharge speed. The control flow illustrated in FIG. 7 (steps S21 to S25) is executed every time the recording apparatus 1 performs recording by a predetermined amount, similarly to the flow illustrated in FIG. 5. FIG. 7 differs from FIG. 5 described in the first exemplary embodiment in step S24. In step S24, the CPU 302 stores the rate of variation in the discharge speed calculated in step S23 illustrated in FIG. 7 in the nonvolatile memory in the recording head 705. Since the rate of variation in the discharge speed is stored in the nonvolatile memory in the recording head 705, a driving condition can be set based on the rate of variation in the discharge speed even if the recording head 705 is mounted on another recording apparatus 1.

The above-mentioned control may be performed by providing the nonvolatile memory with an address for storing the number of times of mounting on the recording apparatus 1 and referring to a value of the address.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-015850 filed Jan. 27, 2010, which is hereby incorporated by reference herein in its entirety.

What is claimed is:

1. A recording apparatus to perform recording by using a recording head to discharge ink, the recording apparatus comprising:

a first acquisition unit configured to acquire an ink discharge speed of the ink discharged from the recording head;

a second acquisition unit configured to acquire information relating to a speed change based on the ink discharge speed acquired by the first acquisition unit and a reference speed;

a setting unit configured to set driving information relating to the recording head; and a drive unit configured to drive the recording head based on the driving information set by the setting unit, wherein the driving information includes a heater drive pulse having a prepulse and a main pulse, and wherein the setting unit changes at least one of a pulse width related to time and a pulse height related to voltage for the prepulse based on the information relating to the speed change acquired by the second acquisition unit.

2. The recording apparatus according to claim 1, wherein the information relating to the speed change includes a rate of the speed change, and a speed ratio to the reference speed.

3. The recording apparatus according to claim 1, wherein the recording apparatus includes the recording head and the recording head includes a storage unit configured to store the information relating to the speed change acquired by the second acquisition unit.

4. The recording apparatus according to claim 3, wherein the recording head is detachably connected to the recording apparatus.

5. The recording apparatus according to claim 3, further comprising a determining unit configured to determine whether the storage unit of the recording head includes information relating to speed change acquired by the second acquisition unit.

6. The recording apparatus according to claim 5, wherein, in response to the determining unit determining that the storage unit of the recording head includes information relating to speed change acquired by the second acquisition unit, the setting unit sets driving information relating to the recording head based on the information relating to the speed change acquired by the second acquisition unit and stored in the storage unit of the recording head.

7. The recording apparatus according to claim 5, wherein, in response to the determining unit determining that the storage unit of the recording head does not include information relating to speed change acquired by the second acquisition unit, the setting unit sets driving information relating to the recording head based on the acquired ink discharge speed stored in the storage unit of the recording head.

8. The recording apparatus according to claim 1, wherein the prepulse is configured to preheat ink to a predetermined temperature and the main pulse is configured to film-boil heat ink to discharge the ink after the prepulse preheatsink to the predetermined temperature.

9. The recording apparatus according to claim 1, wherein, in response to the setting unit changing the pulse width of the prepulse, a pulse width of the main pulse is adjusted so that the heater drive pulse results in a constant total energy input to a heater.

10. The recording apparatus according to claim 1, further comprising a central processing unit, wherein the second acquisition unit and the setting unit are implemented by the central processing unit and the first acquisition unit is an ink droplet discharge speed measurement unit.

11. A method for controlling a recording apparatus to perform recording by using a recording head to discharge ink, the method comprising:

acquiring an ink discharge speed of the ink discharged from the recording head;

acquiring information relating to a speed change based on the acquired ink discharge speed and a reference speed;

setting driving information relating to the recording head; and driving the recording head based on the set driving information, wherein the driving information includes a heater drive pulse having a prepulse and a main pulse, and wherein setting includes changing at least one of a pulse width related to time and a pulse height related to voltage for the prepulse based on the acquired information relating to the speed change.

12. A recording apparatus to perform recording by using a recording head to discharge ink, the recording apparatus comprising:

an acquisition unit configured to acquire information relating to a speed of the ink discharged from the recording head;

a setting unit configured to set a prepulse and a main pulse for driving a heater of the recording head; and a drive unit configured to drive the heater of the recording head based on the prepulse and the main pulse set by the setting unit, wherein the setting unit changes at least one of a pulse width related to time and a pulse height related to voltage for the prepulse based on the information relating to the speed of the ink acquired by the acquisition unit.

13. The recording apparatus according to claim 12, wherein the information relating to the speed of the ink is information about difference of the speed between a speed of the ink discharged from the recording head and a reference speed.

14. The recording apparatus according to claim 12, wherein the recording apparatus includes the recording head and the recording head includes a storage unit configured to store the information relating to the speed of the ink acquired by the acquisition unit.

15. The recording apparatus according to claim 14, wherein the recording head is detachably connected to the recording apparatus.

16. The recording apparatus according to claim 14, further comprising a determining unit configured to determine whether the storage unit of the recording head includes the information relating to speed of the ink acquired by the acquisition unit.

17. The recording apparatus according to claim 12, wherein the prepulse is configured to preheat ink to a predetermined temperature and the main pulse is configured to film-boil heat ink to discharge the ink after the prepulse preheats ink to the predetermined temperature.

18. The recording apparatus according to claim 12, wherein, in response to the setting unit changing the pulse width of the prepulse, a pulse width of the main pulse is adjusted so that the heater drive pulse results in a constant total energy input to a heater.

* * * * *